United States Patent [19]

Wroblewski

[11] Patent Number: 4,949,916

[45] Date of Patent: Aug. 21, 1990

[54] DEVICE FOR DISINTEGRATING MATERIAL, SUCH AS WASTE

[76] Inventor: Franz Wroblewski, Granitvägen 8, S-826 00 Söderhamn, Sweden

[21] Appl. No.: 368,359

[22] PCT Filed: Dec. 9, 1987

[86] PCT No.: PCT/SE87/00585

§ 371 Date: Jun. 7, 1989

§ 102(e) Date: Jun. 7, 1989

[87] PCT Pub. No.: WO88/04200

PCT Pub. Date: Jun. 16, 1988

[30] Foreign Application Priority Data

Dec. 10, 1986 [SE] Sweden ..... 8605288

[51] Int. Cl.[5] ..... B02C 19/22

[52] U.S. Cl. ..... 241/257 R; 241/260.1; 241/261.1

[58] Field of Search ..... 241/DIG. 38, 260.1, 241/246, 247, 248, 253, 257 R, 258, 261.1, 152 A

[56] References Cited

U.S. PATENT DOCUMENTS

| | | | |
|---|---|---|---|
| 934,694 | 9/1909 | Pratt | 241/253 |
| 1,803,230 | 4/1931 | Bing | 241/261.1 |
| 2,902,227 | 9/1959 | Higer | 241/257 R |
| 3,713,596 | 1/1973 | Hoffmann . | |
| 4,767,069 | 8/1988 | Kim | 241/257 R |

FOREIGN PATENT DOCUMENTS

| | | | |
|---|---|---|---|
| 273909 | 4/1918 | Fed. Rep. of Germany . | |
| 2302859 | 7/1974 | Fed. Rep. of Germany . | |
| 2362496 | 6/1975 | Fed. Rep. of Germany . | |
| 3011723 | 10/1980 | Fed. Rep. of Germany . | |
| 1151302 | 4/1985 | U.S.S.R. | 241/257 R |
| 304233 | 3/1930 | United Kingdom . | |

*Primary Examiner*—Mark Rosenbaum

*Attorney, Agent, or Firm*—McFadden, Fincham, Marcus & Allen

[57] ABSTRACT

A device for disintegrating material, such as waste, comprising a rotatable drum (30) having an inlet opening (10) and one or more outlet openings, and a counterbody (32) disposed inside the drum, one or more helical members (31) being provided on the inside of the drum and adapted to convey, during rotation of the drum, the material received in the drum in a downward direction towards a gap (33) between the outside of the counterbody and the inside of the drum. At least an upper part (32') of the counterbody tapers towards the inlet opening (10) and a polygonal, e.g. hexagonal, in cross-section, one or more helical or inclined counterblades (34) being arranged on the outside of said upper part (32').

9 Claims, 3 Drawing Sheets

DEVICE FOR DISINTEGRATING MATERIAL, SUCH AS WASTE

TECHNICAL FIELD OF THE INVENTION

The invention relates to a device for disintegrating material, such as waste, comprising a rotatable drum which is supported by a stand and has an inlet opening and one or more outlet openings, and a counterbody disposed inside the drum, one or more helical or helically arranged members being provided on the inside of the drum and adapted to convey, during rotation of the drum, the material received in the drum in a downward direction towards a gap between the outside of the counterbody and the inside of the drum.

PRIOR ART TECHNIQUE

DE patent specification No. 273,909 discloses a device for disintegrating elongate metal chips, comprising a conical drum which is provided with helical internal ridges and which can be rotatable, and a body disposed inside the drum and being in the form of a mandrel onto which the chips can be wound and subsequently conveyed by the helical ridges down into a stamping mill in which the actual disintegration of the chips into fine material is effected. Moreover, DE Offenlegungsschrift No. 2,302,859 discloses a device for disintegrating chips, comprising a rotatable drum and a body disposed therein and being in the form of a stationary upright on which there are arranged a number of blades adapted to cooperate with a plurality of sheet metal members which are helically arranged on the inside of the drum and by which the chips are conveyed downwardly towards a gap extending between the outside of the upright and the inside of the drum and provided with knives for finally disintegrating the chips. What these prior art disintegrating devices have in common is that they are suited for working fine and easily disintegratable material, such as chips, but not coarser material, for example the highly varying types of household waste, since large objects cannot be effectively seized and worked between the screw members on the inside of the drum and the centrally positioned counter body.

BRIEF DESCRIPTION OF THE INVENTIVE IDEA

It is the object of the present invention to eliminate the shortcomings of known disintegrating devices of the type mentioned by way of introduction and to provide a device which is able to effectively work and disintegrate also coarse material. According to the invention, this is achieved in that at least an upper part of the counterbody tapers towards the inlet opening and is polygonal, e.g. hexagonal, in cross-section, and that there are arranged on the outside of said upper part one or more helical or inclined counterblades.

Since the counterbody is designed as stated above, coarse objects received in the drum are successively disintegrated as they pass downwards through the successively tapering space between the counterbody and the drum, more precisely by the interaction of the screw members on the inside of the drum with the counterblades on the outside of the counterbody, and furthermore are subjected to a tumbling and disintegrating or crushing action by the cross-sectionally polygonal shape of the body.

BRIEF DESCRIPTION OF THE ACCOMPANYING DRAWINGS

DETAILED DESCRIPTION OF PREFERRED EMBODIMENTS OF THE INVENTION

Figure 1:
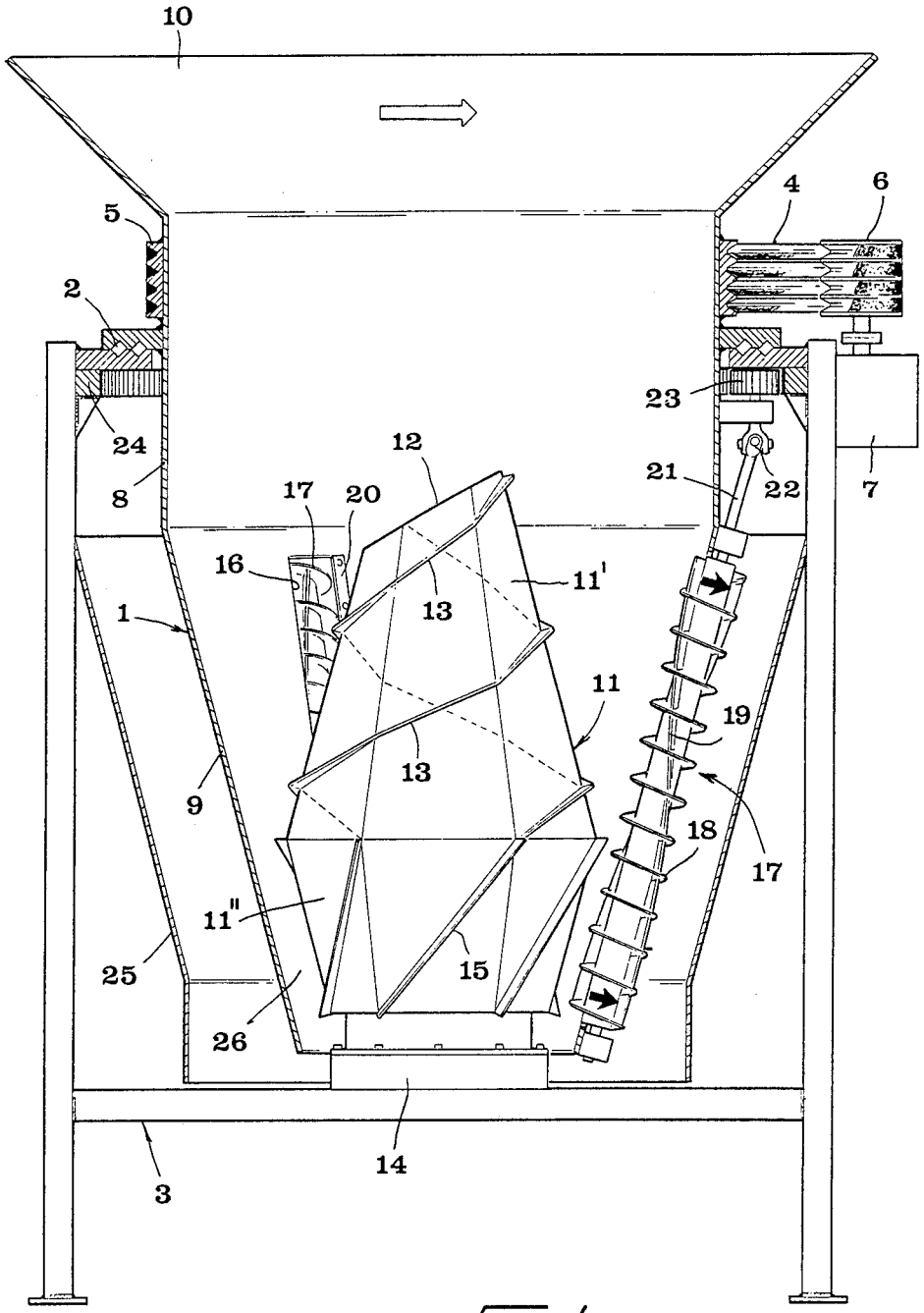
FIG. 1 is a schematic vertical section of a first embodiment of the invention.
Figure 2:
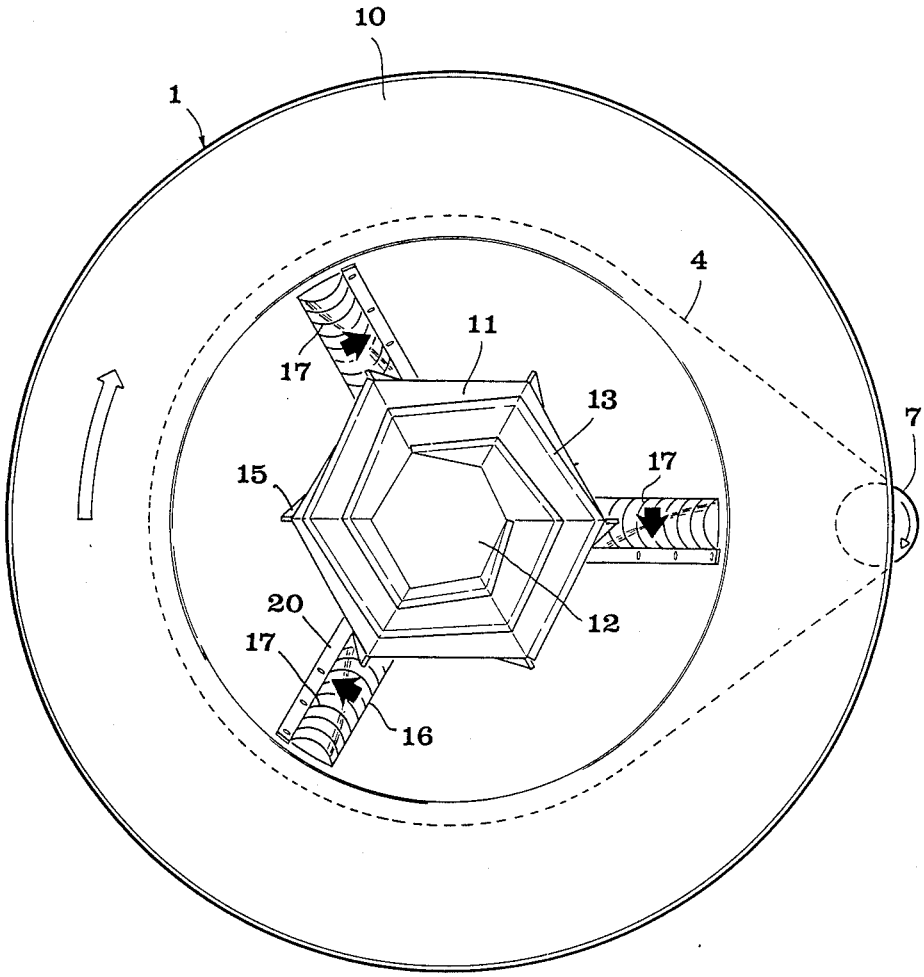
FIG. 2 is a top view of the device in FIG. 1.

In FIGS. 1 and 2, a rotatable drum generally designated 1 is supported by a stand which in its entirety is designated 3. The drum 1 is mounted on the stand by means of a bearing 2. The drum is rotated by means of a driving motor 7 connected to the drum via a transmission having one or more V-belts 4 running between pulleys 5 and 6 which are mounted on the drum 1 and on the output shaft of the motor 7, respectively. The drum 1 comprises a cylindrical upper portion 8 and a lower portion 9 which in this case is conical. At the top of the cylindrical portion 8 of the drum, there is arranged a conically tapering feeding hopper 10 which forms an inlet opening of the drum. Mounted in the lower end of the conical drum portion 9 is a body which in its entirety is designated 11 and comprises an upper part 11' and a lower part 11". According to the principle of the invention, the upper part 11' of this body tapers upwardly towards the inlet opening 10 and is polygonal, in this case hexagonal, in cross-section. The part 11' thus has the shape of a hexagonal truncated pyramid. Also the lower part 11" has in this case a tapering and cross-sectionally polygonal shape. In this case, however, the lower part converges downwardly. More precisely, the outside of the lower part 11" extends substantially in parallel with the surrounding downwardly tapering portion 9 of the drum 1, while leaving a narrow annular gap 26 between the lower part 11" and the drum. In other words, the part 11" closes the lower portion of the drum except for the gap 26 which serves as an outlet opening for worked material. The upper part 11' of the body 11 which below is called counterbody, is terminated at the top by a surface 12 which is inclined relative to the axial direction of the drum. The outside of the part 11' is provided with several counterblades 13, in this case two, extending substantially helically around said part. Analogously, also the lower part 11" of the body 11 is provided with counterblades or knives 15 which are inclined relative to the axial extension of the body. In the example shown, the counterbody 11 is stationarily mounted in that it is attached to a base 14 which, in turn, is fixedly attached to the stand 3. However, it is also conceivable to make the counterbody 11 rotatable, preferably in a direction of rotation opposite to that of the drum 1.

The conical lower portion 9 of the drum 1 has several longitudinal openings 16, in this case three, and in each of these openings, a screw 17 is arranged which in the preferred example as shown comprises two differently pitched, helical cams or edges 18, 19. Each such screw 17 is positioned adjacent and cooperates with a counterblade or cutting edge 20 provided on the edge of the drum wall which defines the opening 16. The pivot shaft 21 of the screw 17 is positioned outside the drum, and only a part of the circumference of the screw extends into the drum through the opening 16. Via a transmission comprising a universal joint 22, a gear wheel 23 and a gear rim 24 fixedly attached to the stand 3, each screw 17 will be automatically rotated as soon as the drum 1 is rotated by means of the driving motor 7. In other words, one and the same drive source is used for driving the screws 17 and for rotating the drum. The pitch of the screw edges or cams 18 is selected such that, when the screws are rotated, the material in the drum will be conveyed downwards in the drum and pressed into the gap 26, provided that the material has not been finally disintegrated to such an extent that it has already been supplied by the cams 19 into the spaces between the screws and the counterblades 20.

A shielding hood 25 is arranged around the conical lower portion 9 of the drum, preferably in the area adjacent the screws 17.

The device described above functions in the following manner. When the drum 1 is rotated by means of the driving motor 7, also the screws 18 will be rotated about their shafts 21 via the transmission 22, 23, 24. The material, such as waste which has been supplied to the drum for disintegration, will then be conveyed by the cams 18 of the screws 17 downwards in the drum, at the same time as a certain amount of the material is disintegrated owing to the interaction of the screws 18, 19 with the associated counterblades 20. The disintegrated material is discharged through the openings 16 in the drum wall and is collected by the surrounding hood 25 which guides the material into a hopper or conveyor (not shown) disposed under the drum. The material still remaining in the drum will rotate with the drum, since the screws 17 partly extend into the drum and move the material along. Since the body 11 is fixedly mounted, the material will be screwed further downwards under the action of the fixed counterblades or knives 13 arranged on the body 11 and will be shorn to pieces and/or crushed by the same, and at the same time urged against and worked by the continuously rotating screws 17. Since the upper part 11' of the counterbody is hexagonal or otherwise polygonal in cross-section, the material will be pressed down into pockets or spaces which are widest in the area midway between two neighbouring edges of the pyramid-shaped part 11' and successively decrease in width in a direction towards these edges. Consequently, the material will be tumbled and pressed down into pockets in which it can be effectively crushed or disintegrated by the interaction of the counter blades 13 with the screws 17. The remaining material which has not been disintegrated before reaching the gap 26 between the lower part 11" of the counterbody and the drum, will be disintegrated in this gap by the interaction of the screws 17 with the fixed knives or counterblades 15, whereupon the material falls down into the area under the drum. The polygonal cross-section of the counterbody further prevents the material from clogging during its downward movement, an effect intensified by the inclined surface 12 terminating the pyramid body 11'.

In the embodiment shown in FIGS. 1 and 2, there is provided in each opening 16 in the drum wall only one screw which cooperates with a counterblade. It is also conceivable to arrange two screws in each opening, the screws being provided with opposite pitches and being rotated in opposite directions such that the material is cut to pieces by the interaction of the screws; the disintegrated material is discharged between the rolls, at the same time as the screws exercise a downwardly conveying effect on the material which is still in the drum. In this case, the edges of the drum openings 16 need not be provided with cutting edges or counterblades.

Figure 3:
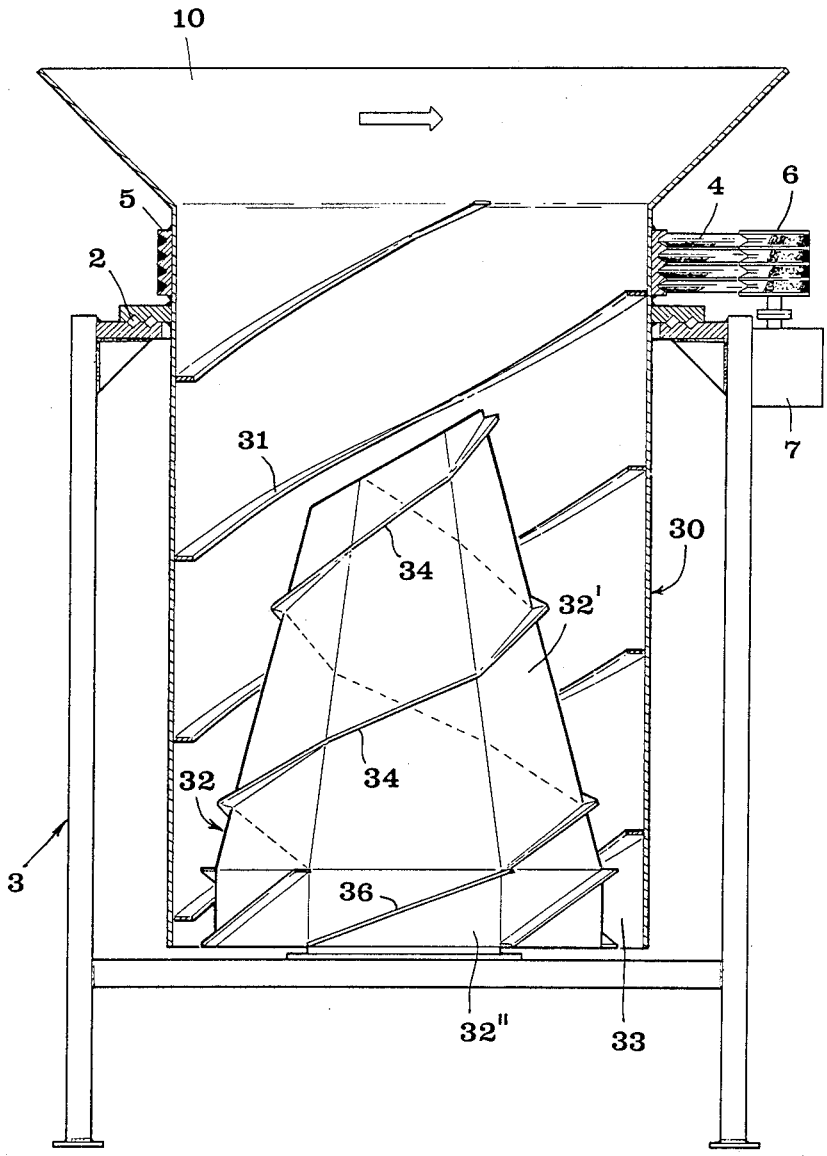
FIG. 3 is a schematic vertical section of an alternative embodiment of the invention.

FIG. 3 illustrates an alternative simplified embodiment of the invention. In this case, the inside of a cylindrical drum 30 is provided with one or more fixed screw members 31 in the form of ridges or cams extending helically from the upper to the lower end of the drum. As in the preceding case, the drum 30 is supported by a stand 3 and is rotatably mounted by means of bearings 2. The drum is rotated by a driving motor 7 via a belt transmission 4, 5, 6. The pitch of the fixed screw members 31 is selected such that the material in the drum will not only be conveyed downwards through the drum upon rotation thereof, but also be disintegrated by the screw members in collaboration with the counterbody which in its entirety is designated 32. The counterbody 32 comprises, as in the preceding case, an upper part 32' having the shape of a hexagonal truncated pyramid, i.e. a body tapering upwardly and being polygonal in cross-section in optional sections along the longitudinal axis of the body. The lower part 32" of the counterbody 32 comprises vertical lateral surfaces which are positioned quite close to the inside of the drum 30, while leaving a relatively narrow gap 33 between the counterbody and the drum. The upper part 32' is provided with one or more helical counterblades or cams 34. Analogously, the lower part 32" is provided with a plurality of inclined or helically arranged counterblades 36. In actual practice, the last-mentioned counterblades may be replaced by or supplemented with separate knives of a smaller size which are arranged in a suitable pattern on the outside of the lower part. Also in this embodiment, the material will be effectively conveyed or supplied down through the drum and at the same time be crushed and cut to pieces by the interaction of the fixed screw members 31 serving as cutting means with the counterblades 34, 36 on the counterbody 32 which is fixedly mounted on the stand 3. In this case, all the disintegrated material will pass through the gap 33 which forms the only outlet opening of the device.

Also in the embodiment according to FIG. 3, the counterblades 34, 36 on the fixed counterbody 32 are suitably designed with a pitch which is opposed to the pitch of the screw member 31 on the inside of the drum 30. Since, according to the principle of the invention, the body 32 is polygonal in cross-section, there is formed also in this case, in the area outside each individual planar boundary surface of the body, a pocket whose depth decreases in a direction towards the outer edges of the surface. These pockets ensure that the conveyed material is effectively tumbled and that also coarser objects included in the material can be collected and worked between the rotating screw cams 31 and the counterblades or knives 34, 36 for effectively disintegrating the material. The embodiment shown in FIG. 3 is advantageous insofar as the device can be manufactured in a simple and inexpensive manner.

In practice, the device according to the invention may be used for a plurality of applications, e.g. the disintegration of wood, household waste, garden waste, peat, industrial waste etc In the two embodiments as illustrated, the disintegrating device has the axis of rotation of the drum vertically oriented. However, it is also conceivable to orient the drum obliquely in relation to the vertical plane, or even horizontally. One possible application is refuse chutes and pneumatic disposal units In this case, the drum can be designed as a rotatable pipe member included in a waste conveyor, the driving motor of the drum being readily accessible outside the pipe. A particularly convenient embodiment for this purpose is the one shown in FIG. 3, since it has no moving internal components whatsoever. In pneumatic disposal units, the orientation of the drum is less important since the vacuum system in the unit can, wholly or partly, replace the effect of gravity.

I claim:

1. In a device for disintegrating material, such as waste, comprising a rotatable drum having an inlet opening and at least one outlet opening, a stand for supporting said drum, a counterbody disposed inside said drum, a gap located between said counterbody and the inside of said drum, and at least one helically arranged member being provided on the inside of said drum and adapted to convey, during rotation of said drum the material received in said drum in a downward direction towards said gap, the improvement wherein said counterbody has an upper portion and a lower portion, at least said upper portion of said counterbody tapering towards said inlet opening and being of a polygonal cross-section, and wherein said upper portion of said counterbody has at least one inclined counterblade arranged thereon.

2. A device as claimed in claim 1, wherein said lower portion of said counterbody extends substantially parallel with a surrounding portion of said drum to form said gap, the outside of said lower portion of said counterbody having cutting means cooperating with said at least one helically arranged member.

3. A device as claimed in claim 1, wherein said upper portion of said counterbody terminates in a surface which is inclined relative to the axis of rotation of said drum.

4. A device as claimed in claim 1, wherein said counterbody is mounted in an inclined relationship relative to said drum whereby an imaginary centerline through its upper portion forms an acute angle relative to the axis of rotation of said drum.

5. A device as claimed in claim 1, wherein said drum has a wall provided with at least one opening therein, at least one of said helically arranged members is a rotatable screw having a pivot shaft, said rotatable screw positioned in said at least one opening, said pivot shaft being disposed substantially outside said drum wall and said rotatable screw extending inwardly into said drum through said at least one opening.

6. A device as claimed in claim 5, wherein said device includes drive means for rotating said drum, said drive means including a transmission for rotating said rotatable screw.

7. A device as claimed in claim 5, wherein one opening is provided with only one rotatable screw, and wherein said opening is provided with a counterblade operatively associated with said rotatable screw along an edge of said one opening.

8. A device as claimed in claim 5, wherein one opening is provided with two rotatable screws, said two rotatable screws having opposite pitches and being rotatable in opposed directions.

9. A device as claimed in claim 1, wherein said upper portion has a hexagonal cross-section.

* * * * *